US011678755B2

(12) United States Patent
Lanphear et al.

(10) Patent No.: US 11,678,755 B2
(45) Date of Patent: Jun. 20, 2023

(54) BEVERAGE SIPPER

(71) Applicant: Hey Brands, LLC, Chicago, IL (US)

(72) Inventors: David Lanphear, Chicago, IL (US); Steven Bucaro, Elwood, IL (US)

(73) Assignee: HEY BRANDS, LLC, Newburyport, MA (US)

( * ) Notice: Subject to any disclaimer, the term of this patent is extended or adjusted under 35 U.S.C. 154(b) by 0 days.

(21) Appl. No.: 17/511,920

(22) Filed: Oct. 27, 2021

(65) Prior Publication Data

US 2022/0167766 A1 Jun. 2, 2022

Related U.S. Application Data

(60) Provisional application No. 63/106,072, filed on Oct. 27, 2020.

(51) Int. Cl.
*B65D 47/06* (2006.01)
*A47G 19/22* (2006.01)

(52) U.S. Cl.
CPC ..... *A47G 19/2266* (2013.01)

(58) Field of Classification Search
CPC ..... A47G 19/2205; A47G 19/2266; A47G 19/2272; A47G 19/2211; A47G 19/2222;
(Continued)

(56) References Cited

U.S. PATENT DOCUMENTS 3,021,977 A 4/1960 Hester
D474,648 S 5/2003 Dimeo
(Continued)

OTHER PUBLICATIONS

Amazon.com product "Sipstar Champagne Flute Sipper . . . " at "https://www.amazon.com/Sipstar-Champagne-Sipper-Korbel-Bottles/dp/B09WF8Q.FSB" author unknown, date unknown (prior to invention).

(Continued)

*Primary Examiner* — King M Chu

(57) ABSTRACT

A beverage sipper for use with a beverage bottle such as a sparkling beverage bottle comprises a stem portion adapted to be releasably inserted into the neck of a beverage bottle, the stem portion comprising a stem wall having an outer surface adapted to contact the neck of the beverage bottle and an inner surface that defines a stem portion beverage passageway and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway. The stem portion has a securing mechanism to secure the stem portion within the beverage bottle. The securing mechanism has a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into the neck of the beverage bottle. When the inward force is removed the biasing mechanism causes at least a portion of the stem wall to be forced outwardly to apply pressure against the neck of the beverage bottle when the stem portion is inserted in the beverage bottle. The securing mechanism is configured to allow the stem portion to be secured to beverage bottles have different diameter necks.

20 Claims, 5 Drawing Sheets

(58) Field of Classification Search
CPC .... A47G 21/18; B65D 25/48; B65D 2251/08; B65D 2517/0049; B65D 47/06
USPC ..... 220/287, 709, 212
See application file for complete search history.

(56) References Cited

U.S. PATENT DOCUMENTS

| | | | | |
|---|---|---|---|---|
| 8,556,136 | B2 | 10/2013 | Huynh | |
| D801,748 | S | 11/2017 | Sullivan | |
| D814,862 | S | 4/2018 | Sullivan | |
| D901,239 | S | 11/2020 | Kehoe | |
| 2014/0001184 | A1* | 1/2014 | Heiml | B65D 39/04 220/287 |
| 2015/0182045 | A1* | 7/2015 | Hobeich | B65D 47/06 215/229 |
| 2020/0085217 | A1* | 3/2020 | Heiberger | B65D 51/24 |

OTHER PUBLICATIONS

Wine-n-gear.com product "Champagne Pourers & Sippers" at "https://www.wine-n-gear.com/product/wholesale-champagne-sipper-pourer/" author unknown, date unknown (prior to invention).

* cited by examiner

BEVERAGE SIPPER

PRIORITY

The present application claims the benefit of domestic priority based on U.S. Provisional Patent Application 63/106,072 filed on Oct. 27, 2020, the entirety of which is incorporated herein by reference.

BACKGROUND

Sparkling beverages, such as Champagne and other sparkling wines and beverages, can turn any event into a festive occasion. The sound of a popping cork is a signal that a party is starting, and the tingle of bubbles on the nose and throat can instantly bring joy to a party goer or celebrant.

While the presence of sparkling beverages at festivities is becoming more and more ubiquitous, the service of the sparkling beverages during the festivities, particularly for large crowds, can have its difficulties. When sparkling beverages are served at an event, there is a need for service staff to open and pour the bottles of sparkling beverage, and there is a need for receptacles for each of the event participants. The current system of service has several disadvantages for the event hosts and/or event participants. For example, the maintenance of an adequate and skilled staff is expensive. Also, especially for large events, participants may have to wait in line for pours or repours of the sparkling beverage. In addition, the receptacles can be problematic. Glass receptacles are expensive, must be cleaned, and can be easily broken. Plastic cups create undesirable waste, can impart undesirable flavors into the sparkling beverage, and can cheapen the feel of an event.

One solution that is becoming popular is to provide or sell guests at an event an individual bottle of sparkling beverage. A standard bottle of sparkling wine is 750 ml and contains from four to six standard 4 to 6 ounce glasses of wine. Thus, a couple or a group can share a bottle of the sparkling wine and avoid the need for finding service staff when a repour is needed. Also, many beverage companies are producing smaller sized bottles for more individual use. For example, a half-sized bottle, also known as demi, is 375 ml and contains the equivalent of two or three glasses of wine. A quarter-sized bottle, also known as a split or a piccolo, is 185-190 ml and contains a little more than a standard single glass of wine. However, while the service of individual bottles to event participants helps with respect to the service issue, the problem remains for receptacles unless the participants drink directly from the bottle. Though drinking directly from the bottle can be entertaining and festive, it may not be suitable for all settings in addition to being potentially messy and unsanitary when a bottle is being shared.

A solution to the bottle service problem was the creation of a sparkling beverage sipper. The sipper has a stem that can be inserted into the neck of a sparkling beverage bottle and a sipping portion that extends from the bottle and creates a funnel-like sipping portion whereby the sparkling beverage can be sipped in a more gentile manner than by placing lips directly on the bottle. However, these conventional sparkling beverage sippers suffer from several disadvantages. For example, the sippers are not universally usable with different sized bottles or necks. Also, the conventional sippers fit within the neck merely by a friction fit which can make the fit either too tight to easily insert or too loose to securely be maintained within the bottle during drinking.

There is therefore a need for in improved beverage sipper. There is further a need for an improved sparkling beverage sipper. There is further a need for a sparkling beverage sipper that is adapted to be used with multiple bottle and/or neck sizes. There is further a need for a sparkling beverage sipper that is more easily insertable into a bottle and/or that provides a more secure fit within a bottle. There is further a need for a sparkling beverage sipper that offers additional advantages or uses over conventional sparkling beverage sippers.

SUMMARY

The present invention satisfies these needs. In one aspect of the invention, an improved beverage sipper is provided.

In another aspect of the invention, an improved beverage sipper is provided that is useable as a wine or spirits sipper.

In another aspect of the invention, an improved beverage sipper is provided that is useable as a sparkling wine sipper.

In another aspect of the invention, an improved beverage sipper is provided that is useable as a Champagne sipper.

In another aspect of the invention, a beverage sipper has a securing mechanism that allows the beverage sipper to be secured within a neck portion of a bottle.

In another aspect of the invention, a beverage sipper has a securing mechanism that allows the beverage sipper to be secured within a neck portion of a bottle in an easy and/or more secure manner.

In another aspect of the invention, a beverage sipper has a securing mechanism that allows the beverage sipper to be secured within different sized neck portions of a bottles.

In another aspect of the invention, a beverage sipper has a securing mechanism that allows the beverage sipper to be secured within a neck portion of a bottle, the securing mechanism comprising bifurcated prongs.

In another aspect of the invention, a beverage sipper has a securing mechanism that allows the beverage sipper to be secured within a neck portion of a bottle, the securing mechanism comprising bifurcated prongs that are biased outwardly.

In another aspect of the invention, a beverage sipper has a securing mechanism that allows the beverage sipper to be secured within a neck portion of a bottle, the beverage sipper further comprising one or more of a seal, a valve, and a stopper.

In another aspect of the invention, a beverage sipper comprises a stem portion adapted to be releasably inserted into the neck of a beverage bottle, and a sipping portion adapted to extend out of the neck of the beverage bottle when the stem portion is inserted in the beverage bottle, wherein the stem portion comprises a securing mechanism to secure the stem portion within the beverage bottle, the securing mechanism comprising a biasing mechanism that biases at least a portion of the stem wall outwardly.

In another aspect of the invention, a beverage sipper comprises a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism comprising a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into the neck of the beverage bottle, and wherein when the inward force is removed the biasing mechanism causes at least a portion of the stem wall to be forced outwardly to apply pressure against the neck of the beverage bottle when the stem portion is inserted in the beverage bottle.

In another aspect of the invention, a beverage sipper comprises a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism comprising a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into the neck of the beverage bottle, wherein when the inward force is removed the biasing mechanism causes at least a portion of the stem wall to be forced outwardly to apply pressure against the neck of the beverage bottle when the stem portion is inserted in the beverage bottle, and wherein the biasing mechanism comprises a bifurcation of the stem wall wherein the stem wall comprises a first prong and a second prong, the first prong and the second prong being separated by a gap, and wherein the first prong and second prong can be moved together to lessen the gap by applying the inward force to the stem wall.

In another aspect of the invention, a beverage sipper comprises a stem portion adapted to be releasably inserted into the neck of a beverage bottle, and a sipping portion adapted to extend out of the neck of the beverage bottle when the stem portion is inserted in the beverage bottle, wherein the stem portion comprises a securing mechanism to secure the stem portion within the beverage bottle, the securing mechanism configured to allow the stem portion to be secured to beverage bottles have different diameter necks.

In another aspect of the invention, a beverage sipper comprises a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism configured to allow the stem portion to be secured to beverage bottles have different diameter necks.

In another aspect of the invention, a beverage sipper comprises a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism configured to allow the stem portion to be secured to beverage bottles have different diameter necks, wherein the securing mechanism is adapted to secure the beverage sipper into beverage bottles having an internal neck diameter across the range of from 14.9 mm to 21.1 mm.

In another aspect of the invention, a beverage sipper comprises a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism configured to allow the stem portion to be secured to beverage bottles have different diameter necks, wherein the securing mechanism is adapted to secure the beverage sipper into beverage bottles having an internal neck diameter across the range of from 17.2 mm to 20.1 mm.

In another aspect of the invention, a method of attaching a beverage sipper to a beverage bottle comprises providing a beverage sipper comprising a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway; applying an inward force to the stem portion to move at least a portion of the stem wall inwardly; inserting the stem portion into the neck of a beverage bottle; removing the application of the inward force once the stem portion is at least partially inserted into the neck of the beverage bottle; and allowing an outward bias of the stem portion to cause the stem portion to press against the neck of the beverage bottle to secure the beverage sipper therein.

In another aspect of the invention, a method of attaching a beverage sipper to a beverage bottle comprises providing a beverage sipper comprising a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway; applying an inward force to the stem portion to move at least a portion of the stem wall inwardly; inserting the stem portion into the neck of a beverage bottle; removing the application of the inward force once the stem portion is at least partially inserted into the neck of the beverage bottle; and allowing an outward bias of the stem portion to cause the stem portion to press against the neck of the beverage bottle to secure the beverage sipper therein, wherein the beverage sipper can be secured within different sized necks of beverage bottles.

In another aspect of the invention, a method of attaching a beverage sipper to a beverage bottle comprises providing a beverage sipper comprising a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway; applying an inward force to the stem portion to move at least a portion of the stem wall inwardly; inserting the stem portion into the neck of a beverage bottle; removing the application of the inward force once the stem portion is at least partially inserted into the neck of the beverage bottle; and allowing an outward bias of the stem portion to cause the stem portion to press against the neck of the beverage bottle to secure the beverage sipper therein, wherein the beverage sipper can be secured within beverage bottles having an internal neck diameter across the range of from 14.9 mm to 21.1 mm.

In another aspect of the invention, a method of attaching a beverage sipper to a beverage bottle comprises providing a beverage sipper comprising a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway; applying an inward force to the stem portion to move at least a portion of the stem wall inwardly; inserting the stem portion into the neck of a beverage bottle; removing the application of the inward force once the stem portion is at least partially inserted into the neck of the beverage bottle; and allowing an outward bias of the stem portion to cause the stem portion to press against the neck of the beverage bottle to secure the beverage sipper therein, wherein the beverage sipper can be secured within beverage bottles having an internal neck diameter across the range of from 17.2 mm to 20.1 mm.

DRAWINGS

These features, aspects, and advantages of the present invention will become better understood with regard to the following description, appended claims, and accompanying drawings which illustrate exemplary features of the invention. However, it is to be understood that each of the features can be used in the invention in general, not merely in the context of the particular drawings, and the invention includes any combination of these features, where:

DESCRIPTION

The present invention relates to a beverage sipper for insertion into a bottle. In particular, the invention relates to a beverage sipper insertable into a sparkling beverage bottle or other container. Although the beverage sipper is illustrated and described in the context of being useful for sipping a sparkling wine, the present invention can be useful in other instances, some of which are described below and some of which will be readily apparent to those skilled in the art. Accordingly, the present invention is not intended to be limited to the examples and embodiments described herein.

Figure 1A:
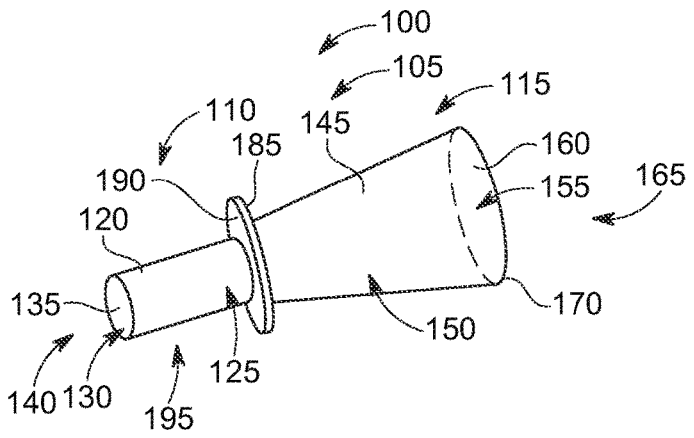
FIG. 1A is a schematic perspective side view of a beverage sipper of the present invention.

FIG. 1A shows a beverage sipper 100 according to one version of the invention. The beverage sipper 100 includes a body 105 having a stem portion 110 and a sipping portion 115. The stem portion 110 has a stem made up of a stem wall 120 having an outer surface 125 and an inner surface 130. The stem wall inner surface 130 defines a stem portion interior passageway 135 that extends from a stem opening 140 at one end to the sipping portion 115 at the other end of the stem portion 110. The sipping portion 115 is made up of a sipping wall 145 that has an outer surface 150 and in inner surface 155. The inner surface 155 of the sipping portion 115 defines a sipping portion interior passageway 160 that extends from the stem portion 110 to a sipping portion opening 165.

Together the stem portion interior passageway 135 and the sipping portion interior passageway 160 are in flow communication with one another to create a beverage passageway that extends from the stem portion 110 to the top of the sipping portion opening 165. The sipping wall 145 can be conically or funnel shaped or at least partially conically or funnel shaped as shown in FIG. 1A or can be any other suitable shape, such as cylindrical or can have a cross section that is oval, ovate, polygonal, or the like, or a combination thereof. The sipping portion opening 165 has a rim 170 or edge at which a beverage or other liquid that flows through the stem interior passageway 135 and through the sipping portion interior passageway 160 can be sipped or poured through the sipping portion opening 165.

Figure 1B:
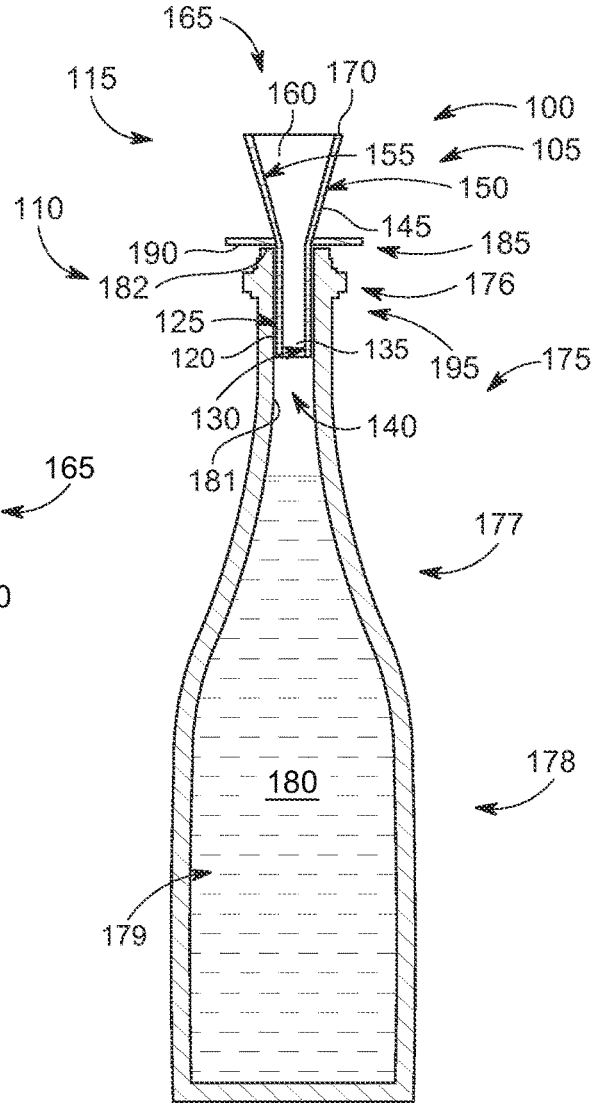
FIG. 1B is a schematic sectional side view of the beverage sipper of FIG. 1A received within the neck of a sparkling beverage bottle.

FIG. 1B shows the beverage sipper 100 of FIG. 1A removeably inserted into a bottle 175, such as a sparkling wine bottle or other beverage containing bottle. The bottle 175 includes a neck portion 176 and a shoulder portion 177 that connects the neck portion 176 to a body portion 178 of the sparkling beverage bottle 175. A sparkling beverage 179 or other beverage is contained within an interior 180 of the sparkling wine bottle 175. A cork or other stopper (not shown) closes the neck portion 176 prior to use of the sparkling wine sipper. After the cork or other stopper is removed the beverage sipper 100 is inserted into the neck portion 176 of the bottle. The stem portion wall outer surface 125 or other part of the stem portion 110 engages an inner surface 181 at or near the top 182 of the neck portion 176 or the bottle 175 to secure the beverage sipper 100 within the neck portion 176 in a manner that will be described further hereinbelow. A flange 185 may optionally be provided on the beverage sipper 100 to limit the depth of insertion of the beverage sipper 100 into the bottle 175 by providing a surface 190 that abuts the top 182 of the neck portion 176. The bottle 175 can be made of glass or other material, such as plastic. In one version, the inner surface 181 of the neck portion 176 is smooth, and the stem portion 110 of the beverage sipper 100 is designed to attach to the smooth surface of the inner surface 181 as will be described.

In one version, the beverage sipper 100 can be a sparkling wine sipper that can be used to drink sparkling wine in an easy and convenient manner. After removing a cork or other stopper from the neck portion 176 of the bottle 175 containing sparkling wine, a beverage sipper 100 is inserted into the neck portion 176 and secured therein. A user can then tip the bottle 175 so that sparkling wine 179 is caused to flow through the stem passageway 135 and the sipping portion passageway 160 and out the sipping portion opening 165. In this manner, a user can place his or her lips on or near the rim 170 and sip the sparkling wine in similar fashion to sipping out of a cup or glass. This allows the bottle 175 of sparkling wine to effectively serve as a receptacle for drinking the sparkling wine 179. The beverage sipper 100 has particular use at events or festivities where sparkling wine is being served to a large group of participants. A host or service staff can merely provide a bottle 175, opened or unopened, and a beverage sipper 100 to a participant, and the participant can enjoy the sparkling wine directly from the bottle 175 without the need for additional receptacles and without the need to drink awkwardly from the top 182 of the bottle 175. This reduces waste and makes the service of the sparkling wine simpler and more efficient. The process also adds uniqueness and festivity to the event as participants can walk around carrying a bottle of sparkling wine, which in addition can be a advertising benefit to the producer of the sparkling wine.

Although the beverage sipper 100 is useful with any wine, beverage, or liquid, it is particularly useful with sparkling wines and the joyous occasions when sparkling wine is served. By sparkling wine it is meant any wine, alcoholic or nonalcoholic, that contains carbon dioxide. Carbon dioxide is a biproduct of fermentation and can be present in the wine as a result of the fermentation process or can be injected thereinto at the time of bottling or after the bottle is opened. Examples of traditional sparkling wines include but are not limited to Champagne from the Champagne region of France; Crémant from various regions in France; Cava from Spain; Franciacorta, Asti, and Prosecco from Italy; Sekt from Germany; Cap Classique from South Africa; and sparkling wine from New World regions such as California, Australia, and Argentina. Sparkling wines also include less traditional types, such as carbonated fruit ciders and juices, beer, sake, water, tonic, soda, and the like, all of which can be alcoholic or non-alcoholic. Various methods of making sparkling wines exist around the world. The traditional method involves a second fermentation of wine in a bottle and the retention of the carbon dioxide produced during the second fermentation within the bottle. The Asti method and the tank method or Charmat process involve fermentation in a tank prior to bottling. The transfer method is similar to the traditional method but with the bottles emptied into a tank following the second fermentation. And the carbonation method involves the injection of carbon dioxide into a base wine.

Sparkling wine bottles 175 come in a variety of sizes. A standard size bottle is designed to contain about 750 ml of sparkling wine which amounts to about four to six standard size glasses of sparkling wine where a "glass" typically consists of four to six ounces of wine. Accordingly, a standard sized bottle of sparkling wine is generally intended to be shared among two or more individuals. Thus, when a beverage sipper 100 is used in conjunction with a standard size bottle, the beverage sipper 100 can be shared, such as by each user using different sides of the rim 170, or individual sparking wine sippers 100 can be given to each user so that each user can have a personalized beverage sipper 100 to insert into the bottle 175 when it is that user's turn to sip the sparkling wine. The same would apply to larger format bottles of sparkling wine, which can include Magnums (1.5 L), Jeroboam (3 L) or Double Magnum, Rehoboam (4.5 L), Methuselah (6 L) or Imperial, Salmanazar (9 L), Balthazar (12 L), Nebuchadnezzar (15 L), Melchior (18 L) Salomon (20 L), Sovereign (25 L), Primat (27 L), and Melchizedek (30 L), with it being noted that these sizes are sometimes given different names and/or used interchangeably. In addition, sparkling wine bottles come in sizes that are smaller than a standard size bottle, and these smaller versions are particularly useful for individual servings in conjunction with a sparking wine sipper 100 of the invention. For example, a half-sized bottle, also known as demi, is 375 ml and contains the equivalent of two or three glasses of wine and a quarter-sized bottle, also known as a split or a piccolo, is 185-190 ml and contains a little more than a standard single glass of wine. Each of the sizes of sparkling wine bottles has an associated neck size. Accordingly, the stem portion 110 can be sized to fit within a desired sparkling wine bottle 175 and/or can be sized to fit within multiple different sized sparkling wine bottles, as will be discussed.

As can be seen in FIG. 1A, the stem portion can include a securing mechanism 195 that allows the beverage sipper 100 to be secured within the neck portion 176 of the bottle 175 in an improved manner. The securing mechanism 195 can serve to allow the beverage sipper 100 to be secured within a sparkling wine bottle 175 by a connection mechanism that is both easy to insert and that connects to the neck in a secure manner. In addition or alternatively, the securing mechanism 195 can serve to allow the beverage sipper 100 to be securable to multiple sized necks.

Figure 2A:
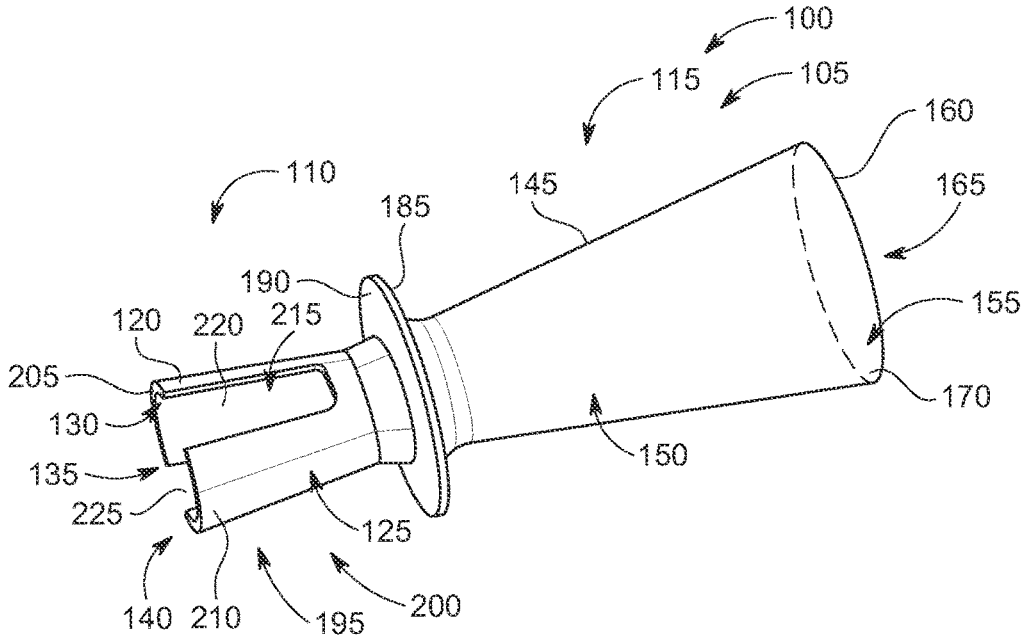
FIG. 2A is a schematic perspective view of another version of a beverage sipper of the invention.

A beverage sipper 100 with a securing mechanism 195 according to a version of the invention is shown in FIG. 2A.

Figure 2B:
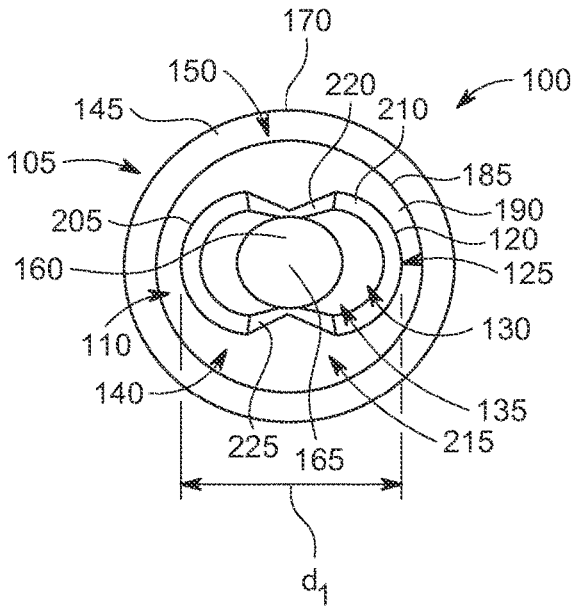
FIG. 2B is a bottom view of the beverage sipper of FIG. 2A in a first configuration.
Figure 2C:
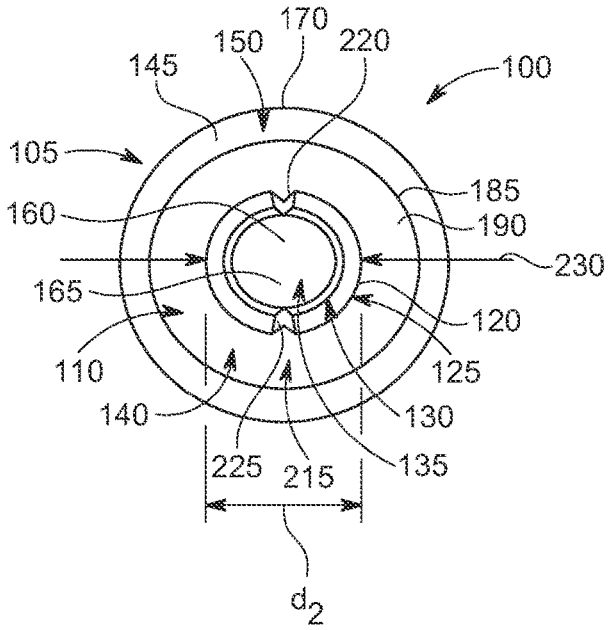
FIG. 2C is a bottom view of the beverage sipper of FIG. 2A in a second configuration.

In this version, the securing mechanism 195 comprises a biasing mechanism made up of a stem portion 110 having a bifurcated stem 200. The bifurcated stem 200 is made up of a first prong 205 and a second prong 210 separated by a gap 215. For example, the gap 215 can comprise a first slot 220 and an opposed second slot 225. The bifurcated stem 200 is biased into the position shown in FIG. 2A, that is it is biased outwardly. The first prong 205 and the second prong 210 can be squeezed towards one another against the bias thereby closing at least a portion of the gap 215. This operation is illustrated in FIGS. 2B and 2C which show bottom views of the beverage sipper 100 of FIG. 2A looking towards the bottom of the first prong 205 and the second prong 210. FIG. 2B shows the bifurcated stem 200 in its natural position or just short inward of its natural position biased outwardly and having a first distance, d1, between the outer surface of the first prong 205 and the outer surface of the second prong 210. In FIG. 2C, an inward force 230 is applied to the outside of the first prong 205 and/or the second prong 210 to overcome the bias and close the gap 215 and bring the prongs closer together to a second distance, d2, between the outer surface of the first prong 205 and the outer surface of the second prong 210. The inward force 230 can be applied, for example, by pinching the prongs together with a user's fingers. In this version, d2 is measurably less than d1. In one particular version, d2 is less than d1 by at least about 2 mm. In another version d2 is less than d1 by at least about 4 mm. In another version, d2 is less than d1 by at least about 6 mm. The inward force 230 required to move the prongs to the position of d2 is a reasonable pinching force by a user of average strength.

Figure 3A:
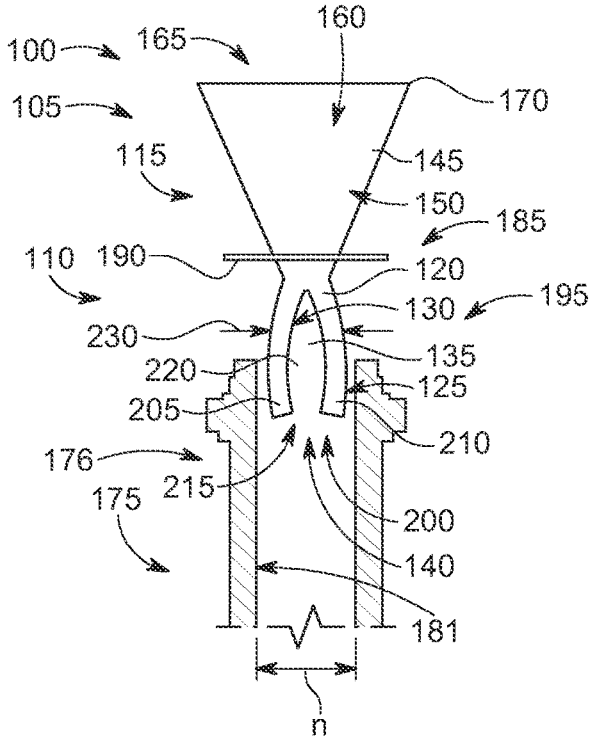
FIG. 3A is a schematic sectional side view of a beverage sipper being inserted into a bottle.
Figure 3B:
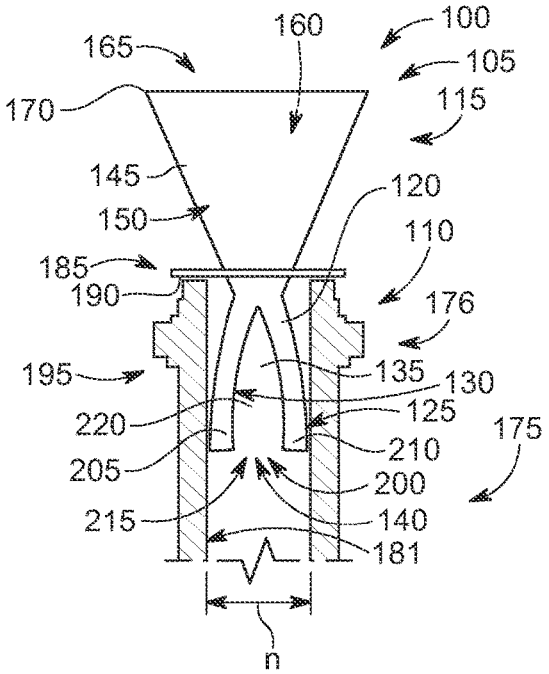
FIG. 3B is a schematic sectional side view of the beverage sipper of FIG. 3A inserted into the bottle.

FIGS. 3A and 3B illustrate schematically the insertion of a beverage sipper 100 according to the version of FIGS. 2A through 2C into a bottle 175 after a cork or other stopper has been removed from the neck portion 176 of the bottle 175. As shown in FIG. 3A an inward force 230 is applied to squeeze the first prong 205 towards the second prong 210 of the bifurcated stem 200 so that the second distance, d2, between the outer surfaces of the respective prongs is less than the cross sectional dimension, n, of the neck portion 176. This allows the stem portion 110 to be easily insertable into the neck portion 176 to the position shown in FIG. 3B. Once in the inserted position of FIG. 3B, the force 230 can be removed, and the first prong 205 and the second prong 210 will move outwardly by the outward bias of the bifurcated stem 200 so that the outer surfaces of each of the first prong 205 and the second prong 210 contact the inner surface 181 of the neck portion 176. The outward bias of the bifurcated stem 200 causes the surfaces to press against the inner surface 181 of the neck portion 176 in a manner that secures the beverage sipper 100 within the neck portion 176 so that it does not come out of the bottle 175 under normal sipping or pouring conditions. Optionally, friction increasing projections or indentations, such as ridges or knobs, can be provided on the outer surface 125 of the stem wall 120 to further secure the stem portion 110 within the neck portion 176 of the bottle 175. Since the inward force 230 is not always able to be applied once a significant portion of the stem portion 120 is inserted into the neck 176, a downward force can be applied when the inward force 230 is removed in order to completely insert the stem portion 120 into the neck 176.

The dimensions of the stem portion 110 can be selected to suit the use of the beverage sipper 100. For example, for a particular cross sectional dimension, n, of the neck portion 176, the bifurcated stem 200 can be designed so that d1 is larger than n and d2 is smaller than n. In this way, since d2 relates to the width of the squeezed prongs of the bifurcated stem 200, when d2 is smaller than n, the stem can be easily inserted into the neck portion 176. Since d1 relates to the width of the outwardly biased bifurcated stem 200 when in its natural configuration, when d1 is wider than the interior of the neck portion 176, the bias will cause the prongs to press against the inner surface 181 of the neck portion 176. In one version, the stem portion 110 can be designed so that d1 is greater than n by at least about 1 mm, by at least about 2 mm, or by at least about 3 mm. Also, the stem portion 110 can be designed so that d2 is less than n by at least about 1 mm, at least about 2 mm, or at least about 3 mm. In one particular example, for a standard sparkling wine bottle having a neck portion with a cross-sectional dimension, n, of about 18 mm, the beverage sipper 100 can be designed to have a d1 of at least about 19 mm and a d2 of about 17 mm or less, or in another version can have a d1 of at least about 20 mm and a d1 of about 16 mm or less.

Figure 3C:
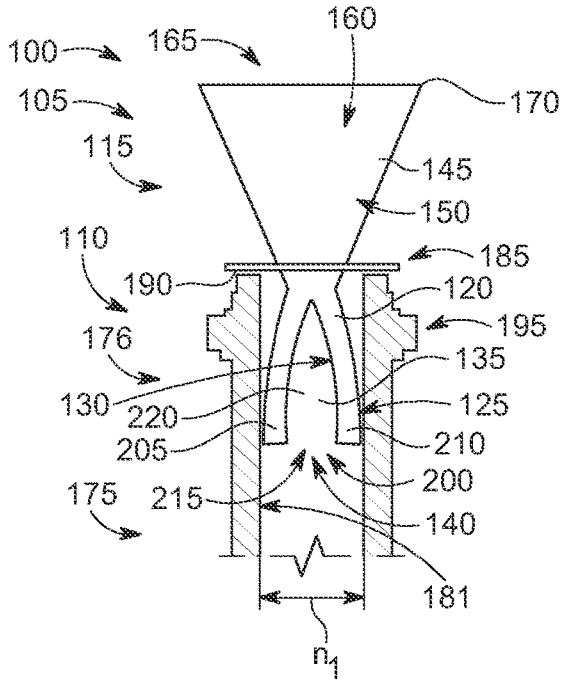
FIG. 3C is a schematic sectional side view of another version of a beverage sipper being inserted into a first bottle.
Figure 3D:
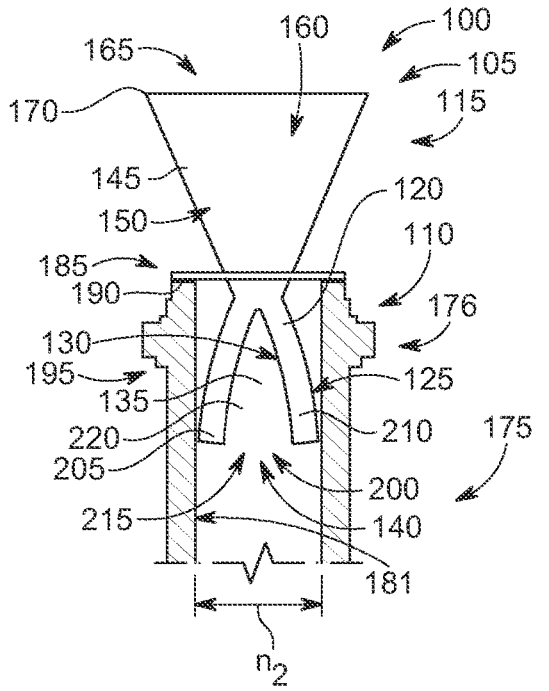
FIG. 3D is a schematic sectional side view of the beverage sipper of FIG. 3C inserted into a second bottle.

In one version, the beverage sipper 100 can be designed, sized, and shaped so that it can fit easily and securely into multiple different sized neck portions 176. This advantageous feature is illustrated in FIGS. 3C and 3D. FIG. 3C shows a beverage sipper 100 inserted into a neck portion 176 having a first cross sectional dimension, n1, and FIG. 3D shows a beverage sipper 100 inserted into a neck portion 176 having a second cross sectional dimension, n2, that is larger than n1. In this version, the same beverage sipper 100 can be used for either sized bottle by designing the securing mechanism 195 and the stem portion 110 of the beverage sipper 100 so that its d1 is larger than n2 and so that its d2 is smaller than n1. In this version, the d1 of the beverage sipper 100 can be at least about 1 mm, or at least about 2 mm or at least about 3 mm larger than n2, and the d2 of the beverage sipper 100 can be at least about 1 mm, or at least about 2 mm, or at least about 3 mm smaller than n1. For example, in a particular version, the beverage sipper 100 can be designed so that it can be used with either an individual sized sparkling wine bottle, such as a 187 ml and/or a 375 ml bottle, and with a standard size sparkling wine bottle. For example, in one version, the beverage sipper 100 can be designed to be used with a first bottle having an n1 of about 16 mm and a second bottle having an n2 or about 18 mm. In this version, the beverage sipper 100 can be designed so that is has a d1 of at least about 19 mm and a d2 of 15 mm or less. Alternatively, one or both of the d1 and d2 can be 2 mm or more or 3 mm or more different than the respective n1 and n2. These designs can be adjusted, respectively, for any desired sizes of n1 and n2. One particular version of the beverage sipper 100 is designed to accommodate several sized openings of sparkling wine bottles. Most sparkling wine bottles have n's than range from about 15.9 mm to about 20.1 mm. Accordingly, in this version, the beverage sipper 100 can be designed to have a d1 of at least about 21.1 mm or at least about 22.1 mm or at least about 23.1 mm and can be designed to have a d2 of about 14.9 mm or less. Accordingly, in one version, the beverage sipper 100 has a securing mechanism 195 that allows the beverage sipper 100 to be secured within bottles having an internal neck diameter across the range of from 14.9 mm to 21.1 mm. By across the range it is meant that the beverage sipper 100 is securable within all bottle neck sizes across the range, i.e. it works with bottles having an internal neck size of 14.9 mm and with an internal neck size of 21.1 and everything in between. By secured it is meant that the beverage sipper 100 fits within the bottle and remains within the bottle during its use as a sipper or pourer. In one particular version, the securing mechanism 195 is adapted to secure the beverage sipper into beverage bottles having an internal neck diameter across the range of from 17.2 mm to 20.1 mm. For the dimensions provided in these examples, the n1 and n2 relate to the smallest internal neck diameter or equivalent cross-sectional dimension. In general, internal neck dimensions are smallest near the top of the neck and gradually widen below the top portion. Alternatively, the equivalent dimensions can be determined for the internal neck dimension at the point of contact with the stem wall 120.

The outer surface 125 of the stem wall 120 of the beverage sipper 100 can have any suitable shape that enables it to be secured to the neck 176 of the bottle 177. For example, in the natural configuration of the stem wall 120, i.e. the configuration of the stem portion 120 when no external force is being applied either by a user or by insertion into a bottle, the outer surface 120 can be at least partially or entirely cylindrical. In another version, in the natural configuration of the stem wall 120, the outer surface 125 of the stem wall 120 can be at least partially or entirely conical so that a lower portion, i.e. a portion that is opposite the sipping portion 115 extends more outwardly than a higher portion.

The securing mechanism 195 of the beverage sipper 100 can be provided by alternative mechanisms to the one shown in FIG. 2A. For example, the stem portion 110 can be provided with three or more outwardly biased prongs rather than two. Alternatively, the bifurcated prongs can be replaced by another design that outwardly biases the stem wall 120. For example, in one version, a spiral or coil spring could be used to outwardly bias the stem wall 120. In any of these alternative mechanisms, the stem portion 110 can have a first dimension, d1, and a second dimension, d2, sized as discussed above.

Figure 4A:
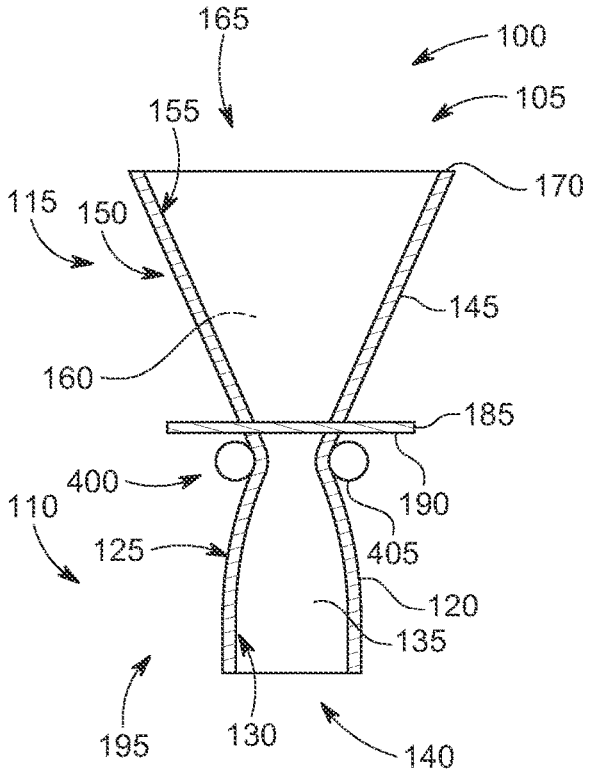
FIG. 4A is a schematic sectional side view of another version of a beverage sipper of the invention.
Figure 4B:
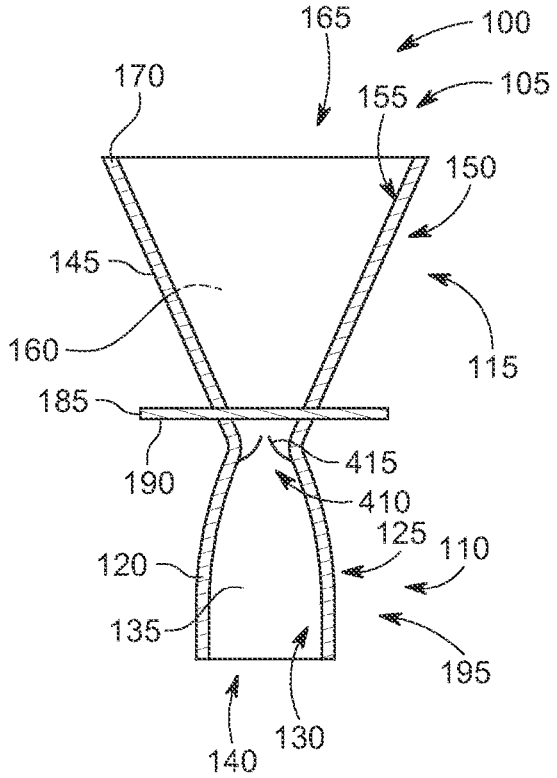
FIG. 4B is a schematic sectional side view of another version of a beverage sipper of the invention.
Figure 4C:
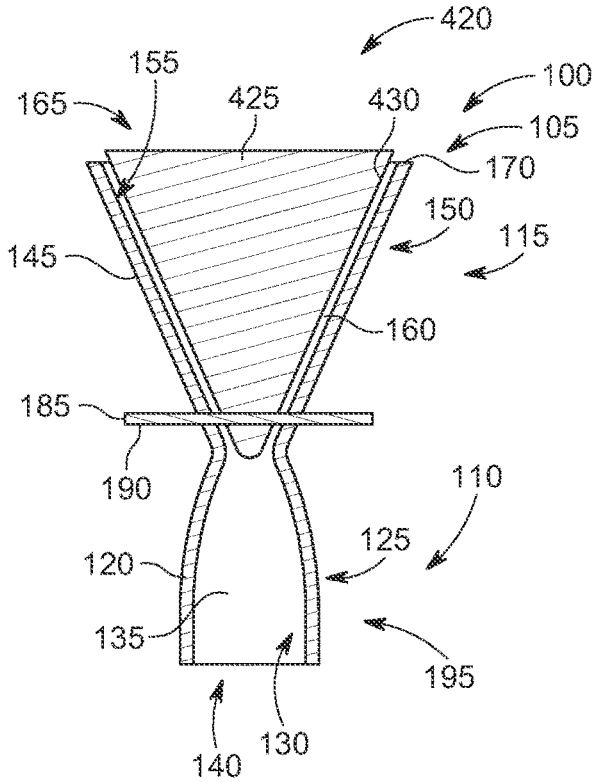
FIG. 4C is a schematic sectional side view of another version of a beverage sipper of the invention.

One or more additional features can also be provided with the beverage sipper 100 of the present invention. For example, as shown in FIG. 4A, one or more seals 400, such as a flexible ring 405 or the like can be provide at or near the stem portion 110 where it can contact a bottle 175 and help to prevent leakage around the stem portion 110. The seal 400 may also provide additional pressure at the top of the stem portion 110 on the neck portion 176 of the bottle 175. This provides two points of pressure, at the top of the stem portion 110 and at the bottom of the stem portion 110 where the stem wall 120 contacts the neck portion 176. In addition or alternatively, the seal 400 may engage with the outside of the bottle 175 to provide internal and/or external seal friction. In another version, as shown in FIG. 4B, a valve 410, such as a one-way valve 415, can be inserted within or between the stem interior passageway 135 and/or the sipping portion interior passageway 160. The valve 410 can be designed to provide multiple functionalities. For example, when a one-way valve 415 is used, the one-way valve 415 can be designed to allow sparkling wine to pass from the bottle 175 to the sipping portion 115. In this way, sparkling wine can be transferred to the sipping portion 115 by tilting the bottle and then when the bottle is turned by upright, some sparkling wine will remain in the sipping portion 115. The sipping portion 115 can then serve as a cup or receptacle from which the sparkling wine can be sipped in a simple manner. Optionally a lid can be provided to cover the sipping portion opening 165 during the transfer process. In another version, the valve 140 can be a flexible flap valve that merely provides a covering across the passageway in the beverage sipper 100. This can help decrease the loss of carbon dioxide from sparkling wine in the bottle 175 which can help maintain the bubbles in the sparkling wine when the beverage sipper 100 is used with a sparkling wine bottle. In another version, the stem portion passageway 135 and/or the sipping portion passageway 160 can be provided with etchings or other imperfections in order to enhance the bubbles emanating from the sparkling wine. In another version, prints, patterns, or other customizations can be provided on the outer surface 150 of the sipping portion 115 or elsewhere on the beverage sipper 100. In the version of FIG. 4C, a stopper 420 provides a cover for the beverage sipper 100. In the version shown, the stopper 420 is made up of a body 425 having a side wall 430 that generally conforms to the inner wall 155 of the sipping portion 115. The stopper 420 can thus be inserted into the interior 160 of the sipping portion 115 when the beverage sipper 100 is not in use to cover prevent items or debris from entering the bottle 175, to reduce the oxygen that is exposed to the beverage in the bottle 175, and/or to reduce the amount of carbon dioxide or other gases or aromas that are released from the bottle 175.

Figure 5A:
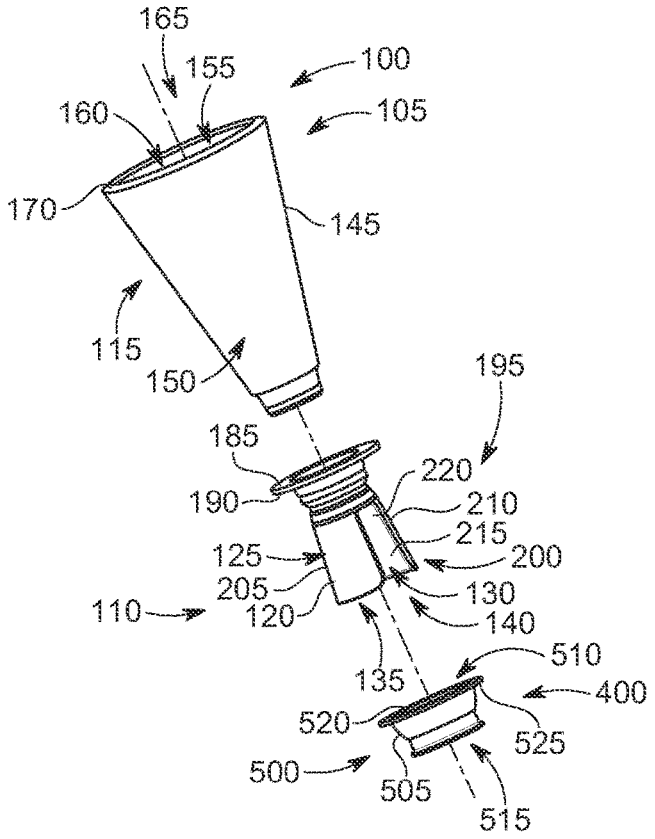
FIG. 5A is an exploded perspective side view of another version of a beverage sipper of the invention.
Figure 5B:
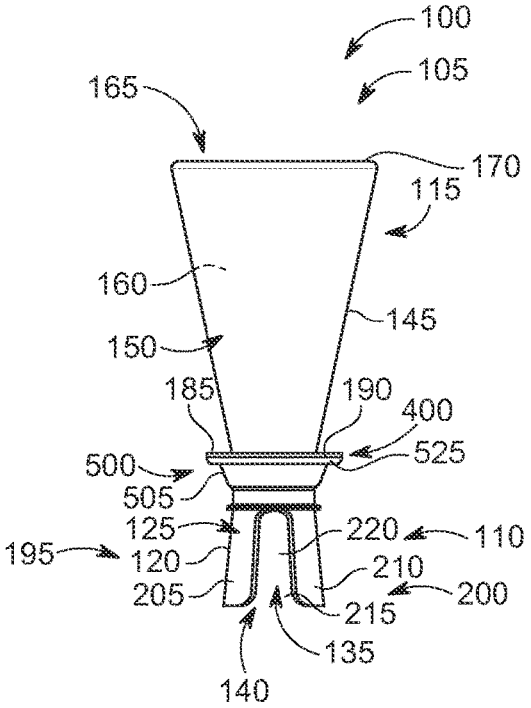
FIG. 5B is an assembled side view of the beverage sipper of FIG. 5A.

Another specific version of the beverage sipper 100 with a seal 400 of FIG. 4A is shown in FIGS. 5A and 5B. In this version, the seal 400 comprises an annular ring seal 500 having a seal body 505. The seal body has an open top 510 and an open bottom 515 with a seal body open interior 520 extending from the open top 510 to the open bottom 515. At least the base of the seal body open interior 520 is sized and shaped to receive the stem portion 110 in a close-fitting and sealing manner. The seal body 505 is installed by extending the stem portion 110 through the open top 520 of the seal body 505 and sliding the seal body 505 into position on the stem portion 110 near the flange 185 of the beverage sipper 100. In the version shown, the seal body 505 has a seal flange 525 that is adapted to abut or nearly abut the bottom surface 190 of the flange 185 of the beverage sipper 100. In this position, the seal body 505 can for a seal with the top 182 of the neck portion 176 of a bottle 175 that the beverage sipper 100 has been inserted into. In one version, the seal body 505 is larger in diameter than the stem wall 120. This can allow for a slight compression of the seal with the neck 176 of the bottle 175. This can also assist in accommodating different sized necks. The flexible seal body 505 can compress internally towards the stem wall 120 for smaller necks 176 and can remain wider for larger necks 176. In addition, the seal body 505 can have one or more flexible rings or projections that extend towards the neck 176 of the bottle 175. These rings or projections can help to prevent or lessen the amount of liquid that passes through the seal created between the beverage sipper 100 and the neck 176. In the version shown in FIG. 5A, the beverage sipper 100 is shown as three separate parts that can be assembled into an integrated beverage sipper 100. The connection between the parts can be by press fit, threaded engagement, adhesive, and/or the like. Alternatively, two or three of the parts can be molded or otherwise produced as a single piece or part.

Though the beverage sipper 100 has been described as being particularly useful for sipping sparkling wine, it can also be used for sipping other types of wine, such a still red, white, orange, and rose wines or other non-sparkling beverages. In addition, the beverage sipper 100 can be used as a pourer instead of a sipper whereby any of the above-mentioned beverages or other liquids can be poured from a bottle. For example, the beverage sipper 100 can be used as a pourer in a tasting room environment where a bottle of wine is opened and small sample pours are made for guests over the course of several hours. Therefore, the use of the word sipper is not intended to imply that the beverage sipper 100 must be used in a manner when a user directly sips from the sipping portion 110 even though that is one method of using the beverage sipper 100.

Although the present invention has been described in considerable detail with regard to certain preferred versions thereof, other versions are possible, and alterations, permutations and equivalents of the version shown will become apparent to those skilled in the art upon a reading of the specification and study of the drawings. For example, the cooperating components may be reversed or provided in additional or fewer number, and all directional limitations, such as up and down and the like, can be switched, reversed, or changed as long as doing so is not prohibited by the language herein with regard to a particular version of the invention. Also, the various features of the versions herein can be combined in various ways to provide additional versions of the present invention. Furthermore, certain terminology has been used for the purposes of descriptive clarity, and not to limit the present invention. Throughout this specification and any claims appended hereto, unless the context makes it clear otherwise, the term "comprise" and its variations such as "comprises" and "comprising" should be understood to imply the inclusion of a stated element, limitation, or step but not the exclusion of any other elements, limitations, or steps. Throughout this specification and any claims appended hereto, unless the context makes it clear otherwise, the term "consisting of" and "consisting essentially of" and their variations such as "consists" should be understood to imply the inclusion of a stated element, limitation, or step and not the exclusion of any other elements, limitations, or steps or any other non-essential elements, limitations, or steps, respectively. Throughout the specification, any discussed on a combination of elements, limitations, or steps should be understood to include a disclosure of additional elements, limitations, or steps and the disclosure of the exclusion of additional elements, limitations, or steps. All numerical values, unless otherwise made clear in the disclosure or prosecution, include either the exact value or approximations in the vicinity of the stated numerical values, such as for example about +/− ten percent or as would be recognized by a person or ordinary skill in the art in the disclosed context. The same is true for the use of the terms such as about, substantially, and the like. Also, for any numerical ranges given, unless otherwise made clear in the disclosure, during prosecution, or by being explicitly set forth in a claim, the ranges include either the exact range or approximations in the vicinity of the values at one or both of the ends of the range. When multiple ranges are provided, the disclosed ranges are intended to include any combinations of ends of the ranges with one another and including zero and infinity as possible ends of the ranges. Therefore, any appended or later filed claims should not be limited to the description of the preferred versions contained herein and should include all such alterations, permutations, and equivalents as fall within the true spirit and scope of the present invention.

What is claimed is:

1. A beverage sipper comprising:

a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism comprising a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into the neck of the beverage bottle, and wherein when the inward force is removed the biasing mechanism causes at least a portion of the stem wall to be forced outwardly to apply pressure against the neck of the beverage bottle when the stem portion is inserted in the beverage bottle, and wherein the biasing mechanism comprises a bifurcation of the stem wall wherein the stem wall comprises a first prong and a second prong, the first prong and the second prong being separated by a gap, and wherein the first prong and second prong can be moved together to lessen the gap by applying the inward force to the stem wall.

2. A beverage sipper according to claim 1 wherein the stem wall outer surface is at least partially cylindrically shaped when in its natural configuration.

3. A beverage sipper according to claim 1 wherein the stem wall outer surface is at least partially conically shaped when in its natural configuration so that the bottom portion of the stem wall extends outwardly more than a top portion of the stem wall.

4. A beverage sipper according to claim 1 wherein the stem wall is moveable inwardly to a position where the cross sectional dimension of the stem wall is at least 2 mm less than the cross sectional dimension of the stem wall when no inward force is applied.

5. A beverage sipper according to claim 1 wherein the stem wall is moveable inwardly to a position where the cross sectional dimension of the stem wall is at least 4 mm less than the cross sectional dimension of the stem wall when no inward force is applied.

6. A beverage sipper according to claim 1 wherein the sipping wall is at least partially conically shaped.

7. A beverage sipper according to claim 1 wherein the beverage sipper comprises a flange between the sipping portion and the stem portion, the flange being adapted to limit the depth of insertion of the stem portion into the bottle.

8. A beverage sipper according to claim 1 wherein the outer wall of the stem portion includes a seal.

9. A beverage sipper comprising:

a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism comprising a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into the neck of the beverage bottle, and wherein when the inward force is removed the biasing mechanism causes at least a portion of the stem wall to be forced outwardly to apply pressure against the neck of the beverage bottle when the stem portion is inserted in the beverage bottle, and wherein the beverage sipper comprises a flange between the sipping portion and the stem portion, the flange being adapted to limit the depth of insertion of the stem portion into the bottle, and wherein the outer wall of the stem portion includes a flexible annular seal, the flexible annular seal abutting the flange.

10. A beverage sipper according to claim 1 wherein a one-way valve is positioned in the stem portion beverage passageway or in the sipping portion beverage passageway.

11. A beverage sipper according to claim 1 further comprising a removable stopper that conforms to an inner wall of the sipping portion.

12. A beverage sipper comprising:

a stem portion adapted to be releasably inserted into the neck of a beverage bottle, the stem portion comprising a stem wall having an outer surface adapted to contact the neck of the beverage bottle and an inner surface that defines a stem portion beverage passageway; and a sipping portion adapted to extend out of the neck of the beverage bottle when the stem portion is inserted in the beverage bottle, the sipping portion comprising a sipping wall with an inner surface that defines a sipping portion beverage passageway that is in flow communication with the stem portion beverage passageway, wherein the stem portion comprises a securing mechanism to secure the stem portion within the beverage bottle, the securing mechanism configured to allow the stem portion to be secured to beverage bottles have different diameter necks, wherein the securing mechanism comprises a biasing mechanism that biases at least a portion of the stem wall outwardly, wherein the bias of the biasing mechanism may be overcome by applying an inward force to the stem wall to move at least a portion of the stem wall inwardly to allow the stem wall to be inserted into different diameter necks of beverage bottles, and wherein when the inward force is removed the biasing mechanism causes at least a portion of the stem wall to be forced outwardly to apply pressure against the different sized necks of the beverage bottles when the stem portion is fully inserted in the beverage bottle.

13. A beverage sipper according to claim 12 wherein the securing mechanism comprises a bifurcation of the stem wall wherein the stem wall comprises a first prong and a second prong, the first prong and the second prong being separated by a gap, and wherein the first prong and second prong can be moved together to lessen the gap by applying an inward force to the stem wall.

14. A beverage sipper according to claim 12 wherein the securing mechanism is adapted to secure the beverage sipper into beverage bottles having an internal neck diameter across the range of from about 16 mm to about 18 mm.

15. A beverage sipper according to claim 12 wherein the securing mechanism is adapted to secure the beverage sipper into beverage bottles having an internal neck diameter across the range of from 14.9 mm to 21.1 mm.

16. A beverage sipper according to claim 12 wherein the securing mechanism is adapted to secure the beverage sipper into beverage bottles having an internal neck diameter across the range of from 17.2 mm to 20.1 mm.

17. A beverage sipper according to claim 1 wherein the bifurcation of the stem wall comprises a third or more prong.

18. A beverage sipper according to claim 9 wherein the biasing mechanism comprises a bifurcation of the stem wall wherein the stem wall comprises a first prong and a second prong, the first prong and the second prong being separated by a gap, and wherein the first prong and second prong can be moved together to lessen the gap by applying the inward force to the stem wall.

19. A beverage sipper according to claim 9 wherein the stem wall is moveable inwardly to a position where the cross sectional dimension of the stem wall is at least 2 mm less than the cross sectional dimension of the stem wall when no inward force is applied.

20. A beverage sipper according to claim 9 wherein the sipping wall is at least partially conically shaped.

* * * * *